US006282828B1

(12) United States Patent
Cecchetto

(10) Patent No.: US 6,282,828 B1
(45) Date of Patent: Sep. 4, 2001

(54) PICTURE FRAME

(76) Inventor: Renzo Cecchetto, 1-258 Russell Avenue, Ottawa, Ontario (CA), K1N 7X5

( * ) Notice: Subject to any disclaimer, the term of this patent is extended or adjusted under 35 U.S.C. 154(b) by 40 days.

(21) Appl. No.: 09/310,176

(22) Filed: May 12, 1999

(51) Int. Cl.[7] ..... A47G 1/16

(52) U.S. Cl. ..... 40/777; 24/3.11; 248/469; 248/174; 40/658; 40/666

(58) Field of Search ..... 40/710, 777, 652, 40/658, 666, FOR 100, FOR 152, FOR 152.1; 248/174, 450, 903, 469, 473; 24/163, 3.12, 311; 211/89.01; 160/352, 351

(56) References Cited

U.S. PATENT DOCUMENTS

| | | | | |
|---|---|---|---|---|
| 1,904,318 | * | 4/1933 | Lehere | 40/791 |
| 2,528,366 | * | 10/1950 | Houston | 40/777 |
| 2,961,789 | | 11/1960 | Hughes | 40/152 |
| 3,694,974 | | 10/1972 | Mukai et al. | 40/152 |
| 4,685,785 | * | 8/1987 | Mundt et al. | 40/777 |
| 5,581,925 | | 12/1996 | Snoke et al. | 40/791 |
| 5,619,816 | | 4/1997 | Ellison | 40/738 |
| 5,933,994 | * | 8/1999 | Misaresh | 40/661 |

FOREIGN PATENT DOCUMENTS

| | | | | |
|---|---|---|---|---|
| 2189779 | | 5/1995 | (CA) . | |
| 964895 | * | 7/1964 | (GB) | 40/100 |

* cited by examiner

*Primary Examiner*—Cassandra H. Davis
(74) *Attorney, Agent, or Firm*—Marks & Clerk

(57) ABSTRACT

A self-supporting, frame system for a photo, print or any other flat material. The system is compromised of at least one flat, stiff piece of material and one main piece of material flexible enough to manually distort slightly. In one embodiment an item to be displayed is sandwiched between two stiff pieces of material and is inserted into a uniquely shaped hole(s) cut into the flexible main piece of the photo frame. The shaped hole(s) is cut such that a portion of the main flexible piece presses against the front of the sandwich while another portion presses against the back of the sandwich. After the sandwich is inserted and the flexible material is allowed to return to its original shape, the sandwich is pressed together effectively capturing the photo or the like in the sandwich. The main flexible portion of the picture frame system is shaped to allow it to stand on a horizontal surface to present the photo, or, alternatively, other material is added to the bottom of the main portion to act as a support for proper presentation.

13 Claims, 6 Drawing Sheets

PICTURE FRAME

FIELD OF INVENTION

This invention relates generally to frames for supporting and presenting photos, pictures or, indeed, any sheet containing decorative or informative data. More specifically it relates to a self-supporting resilient frame member that utilizes the inherent biasing action of the resilient material to clamp the display item.

BACKGROUND

Conventional picture frames typically consist of elongate members of wood, metal, or plastic arranged in a rectangular shape with the corners attached together with adhesives or fasteners. The display item, a photo for example, is placed in the frame along with a transparent front panel and backing material, which are further attached with more fasteners or other hardware. An easel or fold out leg is then used to support the frame on a horizontal surface to present the display item. Alternatively, the frame may have a wire or other suitable fastener appropriately secured for use in hanging the display item or picture on a wall or other vertical surface.

Frames for displaying photographs, etc on a desk or table are frequently made of cardboard or the like and, being light weight, tend to be unstable. Additionally, frames of this type frequently do not provide any protective transparent layer over the photo. Other more stable types typically have a wooden or plastic rectangular frame with a separate glass or transparent plastic front panel. Changing the photo in this latter type can be quite complicated and will normally require tools or special fittings.

U.S. Pat. No. 5,619,816 which issued Apr. 15, 1997 to Hillary Ellison discloses a free standing picture frame in which an article to be displayed is sandwiched between a pair of flexible panels. A cord attached adjacent the outer side edges of the panels is configured such that when it is joined at the rear of the frame the flexible panels are pulled into a curved structure which serves to retain the article and renders the frame free standing. As the article being displayed in this prior art device must also be curved not all types of display medium can be used. Additionally, the curvature of the article may distort the image.

The present invention provides a simple yet effective method of conveniently displaying photos, prints and the like.

SUMMARY OF INVENTION

This invention primarily serves to allow a picture frame to hold a display item without the necessity of additional fasteners. It does this through the use of a specially designed opening(s) in the frame material. When the frame is bent slightly tensile force is imparted to the material. The display item, which may be sandwiched between a transparent front and a stiff backing material, is then inserted into the opening (s) and the assembly is held together by the force of the bent frame attempting to return to its original shape.

It secondarily serves, in the bent mode, to provide a shape that can allow it to support itself on a horizontal surface properly presenting the display material for enjoyment without the use of additional legs or hardware. It can also serve to provide decorative value through the use of interesting material types, shapes and colours.

In its basic form the picture frame of the present invention comprises a frame member made of a resilient material which may be flexed but which will return to its original shape when the flexing forces are removed. The frame member is provided with a suitably positioned opening(s) that is designed to co-operate with a display unit. When the frame member is flexed a laminated or sandwich type display unit is placed through the opening(s). When the flexing force is removed, the resilient material attempts to return to its original form thereby entrapping or clamping the display unit.

Therefore, in accordance with a first aspect of the invention there is provided a picture frame comprising: a resilient frame member having co-operating means for receiving a display unit when the frame member is flexed to a bent state and for clamping the display unit in the frame member when the flexed frame member attempts to return to a non-bent state.

In accordance with a second aspect of the invention there is provided a picture frame assembly comprising a resilient frame member having a cut out means for receiving a display unit in a flexed condition and for retaining the display unit therein when forces causing the frame to flex are removed, the display unit comprising at least one rigid panel to co-operate with the cut out means to maintain the frame member in a state of tension when the forces are removed.

BRIEF DESCRIPTION OF THE DRAWINGS

A better understanding of the invention and further features will now be described in conjunction with the accompanying drawings wherein.

DETAILED DESCRIPTION OF THE INVENTION

Figure 11:
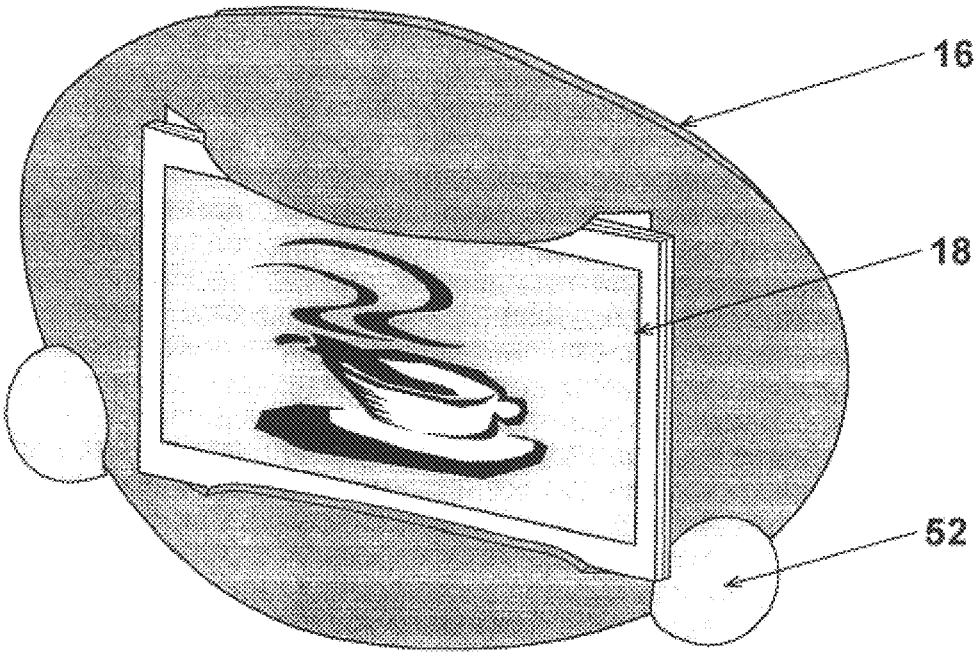
FIG. 11 shows the addition of other material for the purpose of support on a horizontal surface.

As shown in the accompanying Figures the present invention is a self-supporting, self-encapsulating frame system for a photo, print or any other flat material. In one embodiment the system is compromised of three parts, namely; two flat, stiff pieces of material 12, 14, at least one of which is transparent and one main piece of material 16 which is flexible enough to manually distort slightly. The display item 18, a photo or print for example is sandwiched between the two stiff pieces of material 12, 14 and is inserted into a uniquely shaped hole 20 (best seen in FIG. 5) cut into the flexible main piece of the photo frame. The shaped hole 20 is cut such that portions 22, 24 of the main flexible piece 16 presses against the front 12 of the sandwich while other portions 26, 28 presses against the back 14 of the sandwich. After the sandwich is inserted and the flexible material is allowed to return to, or attempt to return to, its original shape, the sandwich is pressed together effectively capturing the photo in the sandwich. The main flexible portion 16 of the photo frame system is shaped to allow it to stand on a horizontal surface to present the photo, or, alternatively, other material (52) is added to the bottom of the main portion 16 to act as a support for proper presentation, as shown in FIG. 11.

The overall size of the system depends on the dimensions of the photo, print or other flat material being presented in the frame 16. The frame may be made in a variety of sizes or may be custom made to accommodate printed material of any particular size. It is anticipated that a version adapted for displaying photographs, for example, will be configured to accommodate the usual range of picture sizes i.e. 3×5, 4×6 etc.

In the embodiment of the invention shown in FIGS. 1 to 5 the display unit is sandwiched between the front protective layer and the stiff backing panel. The face or front panel must be at least partially transparent so as not to cover the image being displayed. Portions of the front panel can however contain decorative markings or patterns designed to further enhance the presentation of the displayed material. The rear panel can be transparent or opaque or any translucency in between. The rear panel can also be formed of a coloured material to further add a decorative border to the material being displayed.

The main body 16 of the frame can be any material, thickness or opacity. It must, however, possess the capacity to be deformed enough to allow the insertion of the display material in combination with the rear and front panels and exert enough pressure on the panels to capture and hold the material in between the panels. Suitable materials include certain metals, wood products and preferably a plastic type material. If the material of the main body possesses great enough flexibility its natural state can be flat and therefore be curved only when the panels and display material are inserted. If the material is not flexible enough or in order to add further decorative effect, the main body can be pre-bent to a variety of curved shapes. It must, however, maintain the ability to be further deformed in order to allow the insertion of the display material in combination with the front and rear panels and exert pressure on the panels when allowed to return to its natural state. Indeed, the main body can be pre-bent such that after the display item is inserted and the additional bending forces removed the frame becomes substantially flat thereby providing for wall mounting applications.

In its curved state, the frame assembly provides itself with sufficient base to allow it to stand on a horizontal surface. The panels or the main body of the frame may assume a variety of shapes in order to provide decorative effect. The visible surfaces of the panels or main body may also be decorated with logos, indicia, added colours or other decorative features at a position that will not interfere with the material being displayed.

Figure 6:
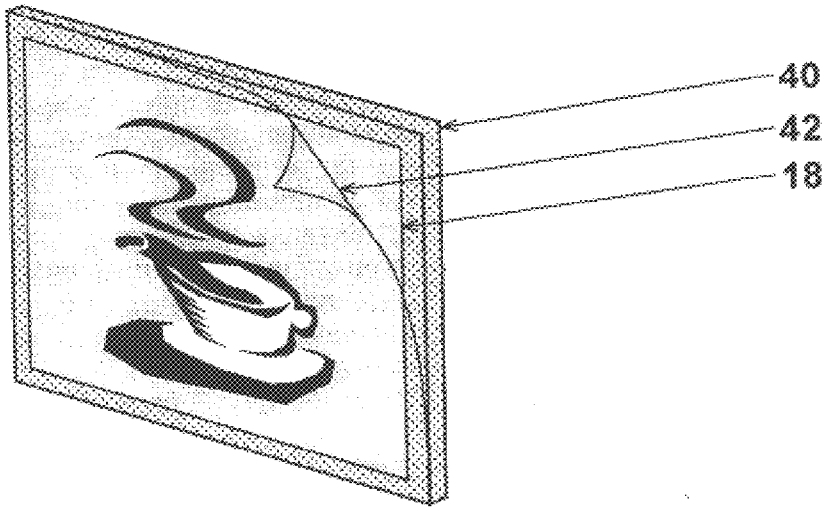
FIG. 6 illustrates an alternate display unit structure.
Figure 7:
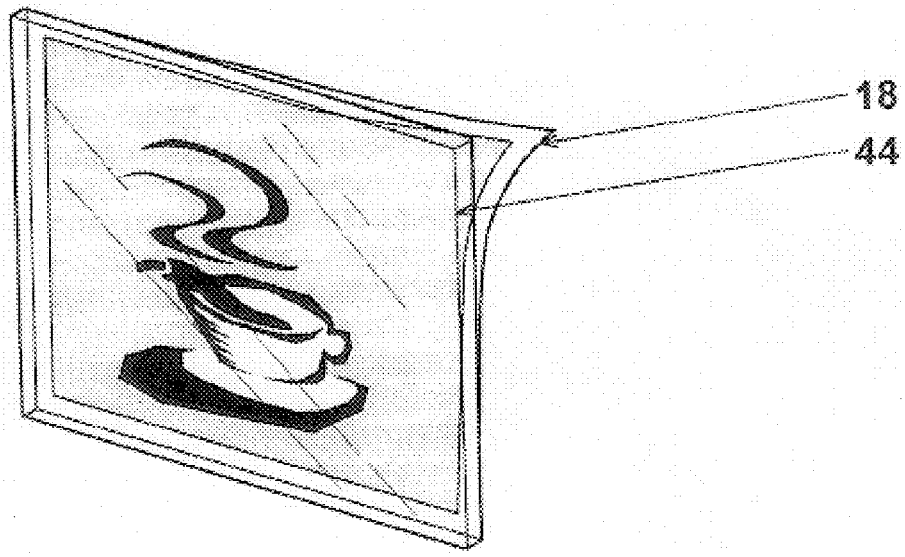
FIG. 7 shows another version of the display unit.
Figure 8:
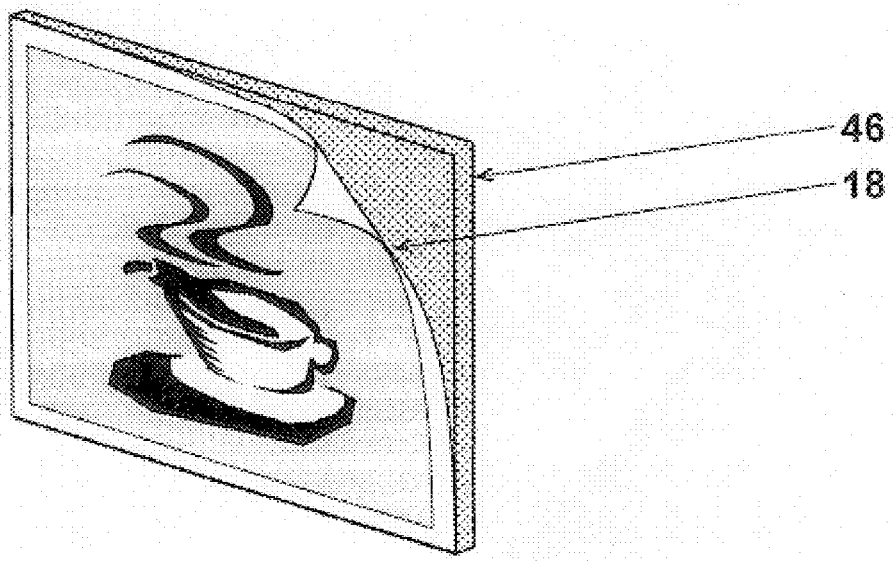
FIG. 8 illustrates a variation on the unit of FIG. 7.

It is also within the scope of the invention for the display item to be of the fixed laminated type with a rigid backing 40 and front protective film 42 rather than a sandwich type. This is shown in FIG. 6. Also, the concept can accommodate just a rigid, transparent front face 44 as shown in FIG. 7 or just a rigid back layer 46 as shown in FIG. 8.

Figure 1:
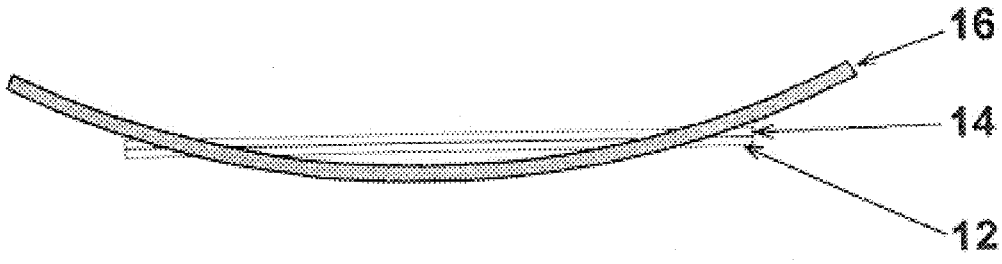
FIG. 1 is the top view of the assembled photo frame according to one embodiment of the invention.
Figure 2:
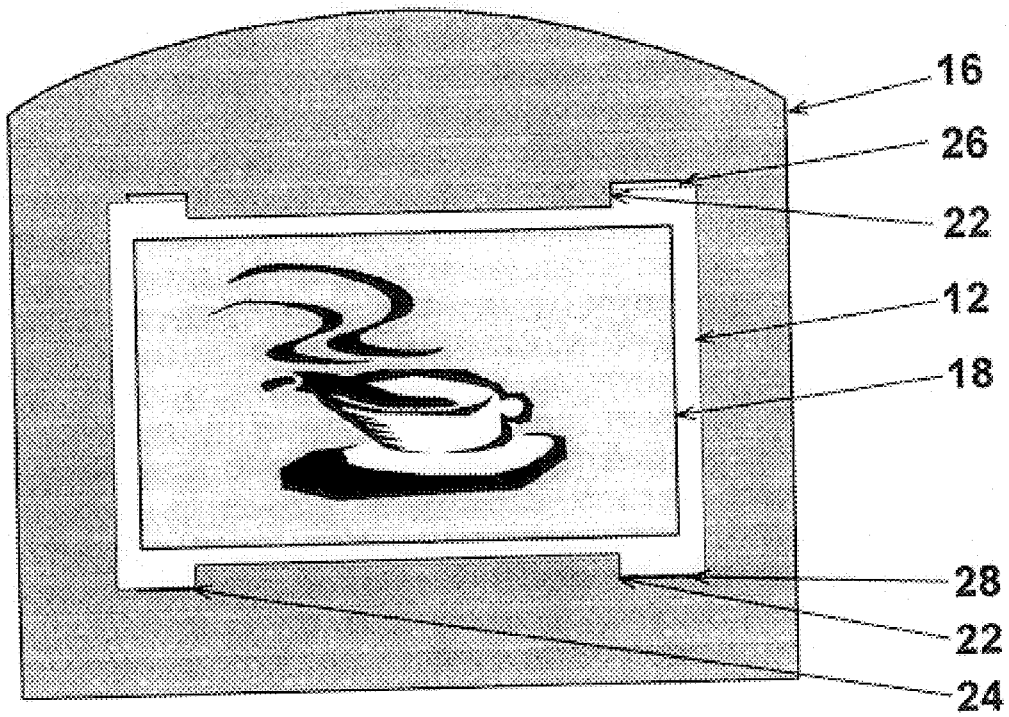
FIG. 2 is the front view of the assembled photo frame of FIG. 1.
Figure 3:
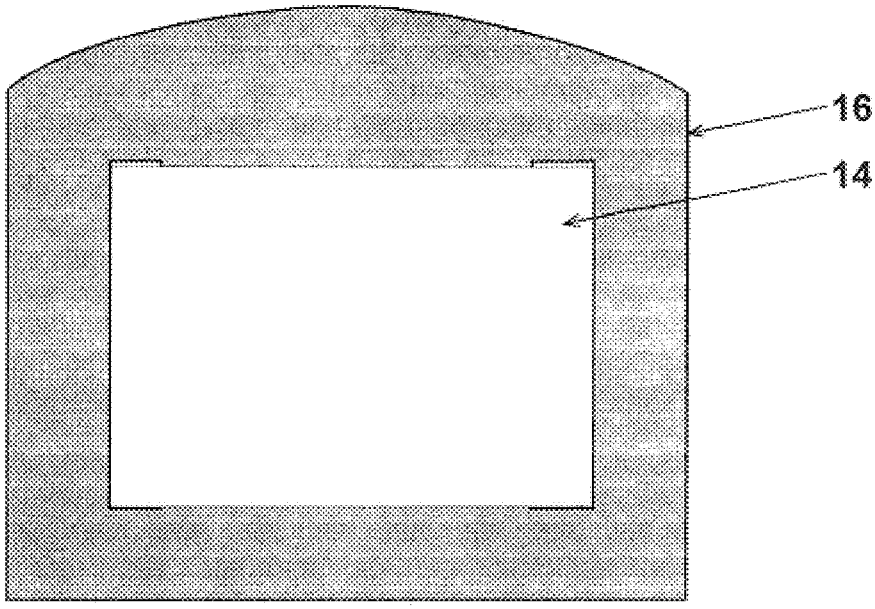
FIG. 3 is the rear view of the assembled photo frame.
Figure 4:
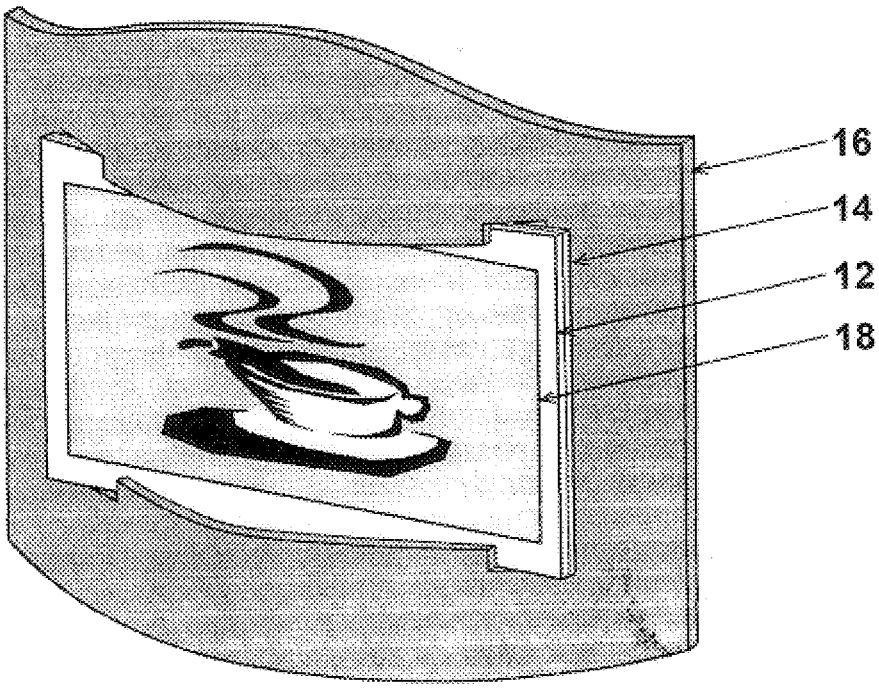
FIG. 4 is a perspective sketch of the assembled photo frame.
Figure 5:
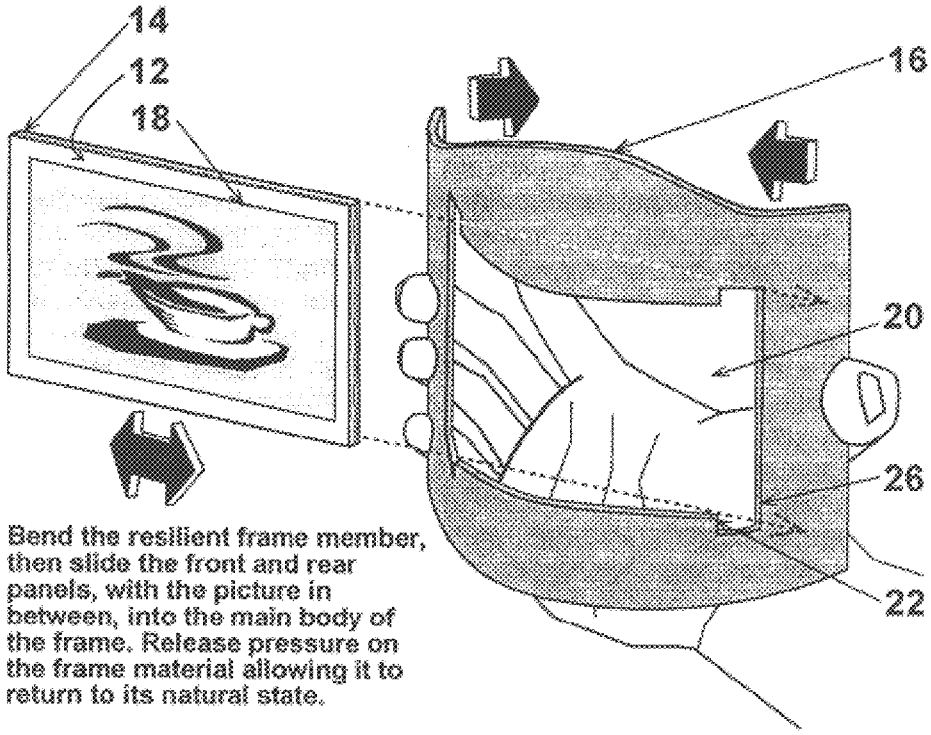
FIG. 5 shows the frame being distorted and the "photo sandwich" being inserted into the flexed material.
Figure 9:
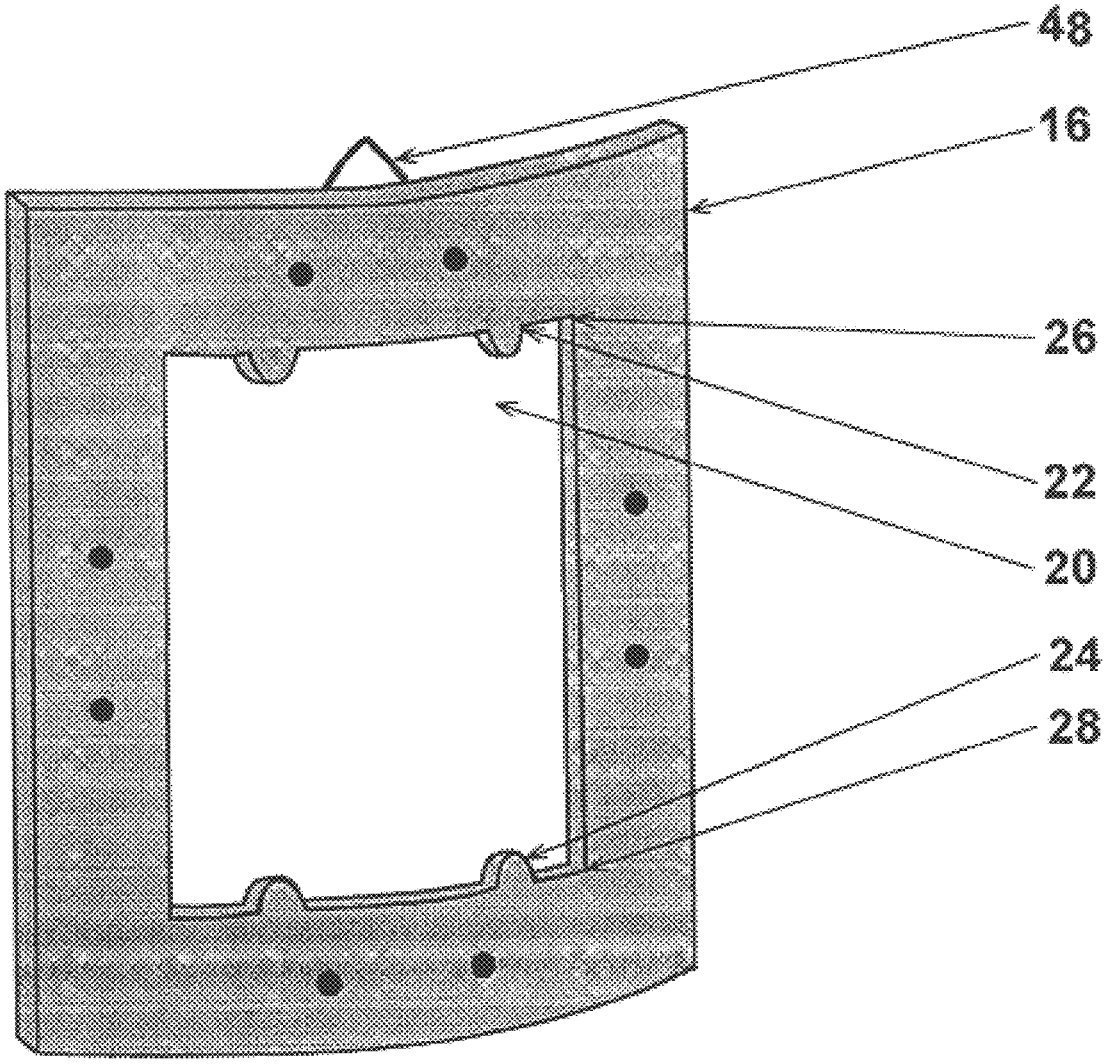
FIG. 9 illustrates a variation on the cut out and the addition of other material for the purpose of hanging the frame on a vertical surface.

A key aspect of the invention is the opening(s) in the frame to receive the display item. As best seen in FIG. 5 the frame member is bent sufficiently to permit the display item to freely slide into the cut out. When the bending forces are removed the display item is securely held by the edges of the cut out. It will be apparent to one skilled in the art that the cut out can be shaped as shown in FIG. 9 and still hold the display item. Also shown in FIG. 9 is a fastening means 48 such as might be used to hang the display item on a wall or other vertical surface.

Figure 10:
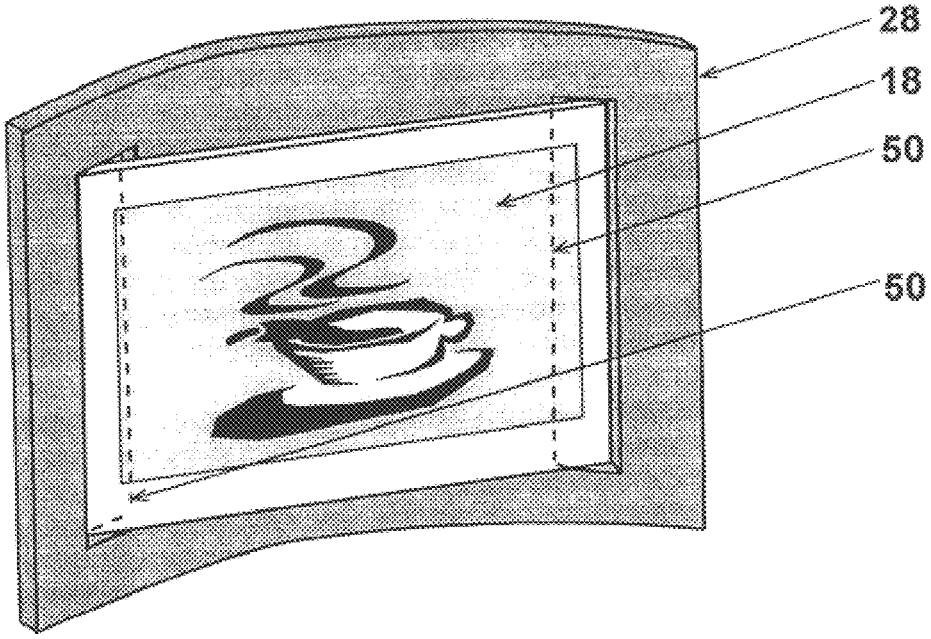
FIG. 10 shows a second embodiment of the cut out according to the invention.

It is also possible to form two slots 50 in the frame member 16 as shown in FIG. 10. In this embodiment, of course the item to be displayed 18 must be placed in the frame as shown in FIG. 10.

As discussed previously the frame according to the present invention will be particularly applicable to the display of photographs and prints on desks, tables etc. It will also be useful for displaying certificates and diplomas. The stability of the assembly and the ease with which the insert can be changed makes the frame particularly well suited for displaying menus or other information such as daily specials in restaurants.

While particular embodiments of the invention have been described and illustrated it will be apparent to one skilled in the art that alternatives and/or variations to the basic concept can be introduced. It is to be understood, however, that such alternatives and/or variations will fall within the scope of the invention as defined by the appended claims.

I claim:

1. A frame and display assembly for supporting and presenting a display item comprising:

a generally rectangular frame member of resilient material capable of being bent into a curved state upon application of a flexing force and of returning to its original state upon removal of said flexing force, said frame member further having a generally rectangular cut out with means in respective corners of said cut out to provide cooperating clamping surfaces; and a display unit, said display unit comprising a display item, a transparent panel and a rigid supporting panel, said transparent panel and said supporting panel dimensioned to fit into said cut out and to mate with said clamping surfaces; whereby said display unit may be inserted into said cut out in said frame member when said frame member is in a curved state thereby clamping said display item between said transparent panel and said supporting panel by said clamping surfaces when said flexing forces are removed and said frame member attempts to return to its original state.

2. A picture frame assembly as defined in claim 1 wherein said substantially rectangular frame member has a least one straight side and when said flexing forces are removed said frame member remains in a curved state whereby said picture frame assembly is self supporting on said one straight side of said frame member.

3. A picture frame assembly as defined in claim 1 wherein said frame member has additional supporting material at said one straight side to provide further support to said self supporting frame.

4. A picture frame assembly as defined in claim 1 additionally having decorative patterning on said frame member.

5. A picture frame assembly as defined in claim 1 wherein said rigid supporting panel has decorative features.

6. A picture assembly as defined in claim 1 wherein said substantially rectangular frame member has hanging means adjacent a top edge for hanging said picture frame assembly on a vertical surface.

7. A picture assembly as defined in claim 1 wherein said display item is selected from the group consisting of a photograph, a print, a menu and an information list.

8. A frame assembly for displaying a display item on a horizontal surface, said frame assembly comprising a frame member being a substantially rectangular plate having at least one straight edge and of a resilient material which is capable of being flexed but which will return to its original form upon removal of flexing forces and having a generally rectangular opening centrally placed in said frame, said opening having vertically extending shallow slots at each corner, said slots forming cooperating clamping means; and a display unit having a display item to be displayed sandwiched between a transparent front cover and a rigid rear panel, said front cover and rear panel being rectangular and having a length that is greater than said opening and having a height generally corresponding to the combined height of said opening and slots, whereby when said rectangular plate is flexed into a curved state said display unit may be inserted into said slots and when flexing forces are removed said display item is clamped between said front cover and said rear panel by said clamping means due to the force of said frame attempting to return to its original form, said picture frame assembly thus being in a curved state whereby said assembly is self supporting by placing said straight edge of said frame member on said horizontal surface.

9. A frame assembly as defined in claim 8 wherein said display item is selected from one of a photograph, a print, a menu and an information list.

10. A frame assembly as defined in claim 8 wherein said frame member has additional supporting material at edge one straight edge to provide further support to said self supporting frame.

11. A frame assembly as defined in claim 8 additionally having decorative patterning on said frame member.

12. A frame assembly as defined in claim 8 wherein said rigid supporting panel has decorative features.

13. A frame assembly as defined in claim 8 wherein said substantially rectangular frame member has hanging means adjacent a top edge for hanging said picture frame assembly on a vertical surface.

* * * * *